US008075709B2

(12) United States Patent
Mihoya

(10) Patent No.: US 8,075,709 B2
(45) Date of Patent: Dec. 13, 2011

(54) SURFACE TREATMENT METHOD FOR ALUMINUM OR AN ALUMINUM ALLOY AND TREATING FLUID USED THEREFOR

(75) Inventor: Makoto Mihoya, Hamamatsu (JP)

(73) Assignee: Suzuki Motor Corporation (JP)

( * ) Notice: Subject to any disclaimer, the term of this patent is extended or adjusted under 35 U.S.C. 154(b) by 1090 days.

(21) Appl. No.: 10/386,230

(22) Filed: Mar. 11, 2003

(65) Prior Publication Data

US 2003/0196729 A1 Oct. 23, 2003

(30) Foreign Application Priority Data

Apr. 19, 2002 (JP) ..... 2002-116891

(51) Int. Cl.
*C23C 22/56* (2006.01)

(52) U.S. Cl. ..... 148/275; 148/240; 148/243; 148/279; 106/14.05; 106/14.11; 106/14.21

(58) Field of Classification Search ..... 148/275, 148/240, 243, 273, 279, 283; 106/14.41, 106/14.12, 14.05, 14.11, 14.21; 428/469; 252/389.3
See application file for complete search history.

(56) References Cited

U.S. PATENT DOCUMENTS

| | | | | |
|---|---|---|---|---|
| 6,106,741 | A * | 8/2000 | Heimann et al. | 252/389.3 |
| 6,171,706 | B1 | 1/2001 | Mihoya et al. | |
| 6,303,232 | B1 * | 10/2001 | Mihoya et al. | 428/472.2 |
| 6,569,537 | B1 | 5/2003 | Nomura et al. | |
| 6,589,324 | B2 * | 7/2003 | Kamo et al. | 106/14.12 |
| 6,607,609 | B2 | 8/2003 | Nomura et al. | |
| 6,753,039 | B2 * | 6/2004 | Heimann et al. | 427/376.1 |
| 2001/0024729 | A1 * | 9/2001 | Heimann et al. | 428/469 |
| 2003/0118861 | A1 * | 6/2003 | Heimann et al. | 428/632 |
| 2004/0081837 | A1 | 4/2004 | Nomura et al. | |
| 2004/0107867 | A1 * | 6/2004 | Gallagher et al. | 106/14.44 |

FOREIGN PATENT DOCUMENTS

| | | |
|---|---|---|
| JP | 53-80339 A | 7/1978 |
| JP | 2001-234352 | 8/2001 |
| JP | 2002-012981 A | 1/2002 |
| JP | 2003-082473 | 3/2003 |

OTHER PUBLICATIONS

Japanese Patent Provisional Publication No. 11-193478. Application No. 10-100320. Filed Mar. 27, 1998. Published on Jul. 21, 1999. English language Abstract.
Office Action corresponding to German Application No. 10309888.7 dated Jan. 25, 2005.
Japanese Office Action corresponding to application No. JP2002-116891, dated Feb. 16, 2007.
Japanese Office Action corresponding to application No. JP2002-116891, dated May 16, 2007.

* cited by examiner

*Primary Examiner* — Roy King
*Assistant Examiner* — Lois Zheng
(74) *Attorney, Agent, or Firm* — Myers Bigel Sibley & Sajovec, P.A.

(57) ABSTRACT

A method for the surface treatment of aluminum or an aluminum alloy which comprises soaking aluminum or an aluminum alloy in a treating fluid containing ammonium silicofluoride and another aluminum-free fluorine compound to form a film thereon, wherein the treating fluid comprises an aqueous solution further containing at least one substance selected from the group consisting of aluminum fluoride, aluminum hydroxide, aluminum silicate, magnesium aluminate metasilicate and powdered aluminum.

3 Claims, 6 Drawing Sheets

SURFACE TREATMENT METHOD FOR ALUMINUM OR AN ALUMINUM ALLOY AND TREATING FLUID USED THEREFOR

BACKGROUND OF THE INVENTION

This invention relates to a method for the surface treatment of aluminum or an aluminum alloy. More particularly, it relates to a method for the surface treatment of aluminum or an aluminum alloy wherein a film is formed thereon by a chemical reaction, without supplying energy (e.g., electricity) externally.

The conventionally employed alumite process is a method for forming a hard film of aluminum oxide on the surface of aluminum by oxidizing aluminum anodically in an acidic bath. However, this method has the disadvantage of involving a high cost because it requires equipment for electric supply and the rate of film formation is slow.

Now, there has been developed a technique for forming a film on the surface of aluminum by heating an aqueous solution containing magnesium silicofluoride and ammonium silicofluoride to a temperature of 70 to 100° C. and soaking aluminum in this aqueous solution (see Japanese Patent Provisional Publication No. 11-193478/'99). This technique makes it possible to simplify the equipment and reduce treating costs and also to form a film having excellent sliding properties on the surface of aluminum.

However, the aforesaid technique shows a tendency in which the thickness of the film formed on the surface of aluminum first treated after bath preparation is small and, subsequently, the film thickness becomes larger as the treated area of aluminum increases. This causes the problem that there is great variation in film thickness among aluminum products.

SUMMARY OF THE INVENTION

Accordingly, in view of the above-described problems, the present inventors made intensive investigations for the purpose of developing a surface treatment method for aluminum or an aluminum alloy and a treating fluid used therefor, which can prevent the film thinning phenomenon occurring in the surface treatment of aluminum immediately after bath preparation and thereby make the thickness of the formed film uniform among aluminum products. As a result, the present inventors have found that the phenomenon in which the film thickness becomes small in the surface treatment immediately after bath preparation is caused by a great pH change to the acid side during the treatment immediately after bath preparation. Moreover, the present inventors have also found that this pH change arises from aluminum ions which dissolve from aluminum and accumulate in the treating fluid. The present invention has been completed from this point of view.

The present invention relates to a method for the surface treatment of aluminum or an aluminum alloy which comprises soaking aluminum or an aluminum alloy in a treating fluid containing ammonium silicofluoride [$(NH_4)_2SiF_6$] and another aluminum-free fluorine compound to form a film thereon, wherein the treating fluid comprises an aqueous solution further containing at least one substance selected from the group consisting of aluminum fluoride ($AlF_3$), aluminum hydroxide [$Al(OH)_3$], aluminum silicate [$Al_2(SiO_3)_3$], magnesium aluminate metasilicate [$Mg(OAlSiO_3)_2$] and powdered aluminum.

Thus, a great pH change to the acid side can be suppressed by adding to the treating fluid an aluminum-containing substance having the same effect as aluminum dissolution occurring during surface treatment immediately after bath preparation. Consequently, a film thinning phenomenon immediately after bath preparation can be prevented, so that a film having a uniform thickness can be formed on the surface of aluminum.

As the aforesaid "other aluminum-free fluorine compound", it is preferable to use magnesium silicofluoride ($MgSiF_6.6H_2O$), zinc silicofluoride ($ZnSiF_6.6H_2O$), potassium silicofluoride ($K_2SiF_6$), sodium silicofluoride ($Na_2SiF_6$) or manganese silicofluoride ($MnSiF_6.6H_2O$).

Moreover, it is preferable that the aforesaid treating fluid comprise an aqueous solution further containing potassium chloride (KCl), potassium hydrogen phthalate [$C_6H_4(COOK)(COOH)$] or potassium dihydrogen phosphate ($KH_2PO_4$).

Thus, when the aforesaid chemical agents which exert a buffering action on the hydrogen ion concentration are added to the treating fluid, the range of pH change can be reduced and, therefore, the thickness of a film formed on the surface of aluminum can be made more uniform.

As to the formulation of the aforesaid treating fluid, it is preferable that the ammonium silicofluoride be added in an amount of 0.01 to 10 parts by weight, the other aluminum-free fluorine compound in an amount of 0.1 to 20 parts by weight, the aluminum fluoride in an amount of 0.02 to 0.5 part by weight, the aluminum hydroxide in an amount of 0.02 to 0.5 part by weight, the aluminum silicate in an amount of 0.04 to 1 part by weight, the magnesium aluminate metasilicate in an amount of 0.04 to 1 part by weight, and the powdered aluminum in an amount of 0.007 to 0.2 part by weight, per 100 parts by weight of water.

Moreover, it is also preferable that the potassium chloride be added in an amount of 0.01 to 5 parts by weight, the potassium hydrogen phthalate in an amount of 0.05 to 10 parts by weight, and the potassium dihydrogen phosphate in an amount of 0.03 to 10 parts by weight, per 100 parts by weight of water.

Furthermore, the present invention relates to a treating fluid for use in the surface treatment of aluminum or an aluminum alloy which comprises an aqueous solution containing ammonium silicofluoride, another aluminum-free fluorine compound, and at least one substance selected from the group consisting of aluminum fluoride, aluminum hydroxide, aluminum silicate, magnesium aluminate metasilicate and powdered aluminum.

It is preferable that the aforesaid "other aluminum-free fluorine compound" be magnesium silicofluoride, zinc silicofluoride, potassium silicofluoride, sodium silicofluoride or manganese silicofluoride. It is also preferable that the treating fluid in accordance with the present invention comprise an aqueous solution further containing potassium chloride, potassium hydrogen phthalate or potassium dihydrogen phosphate.

Accordingly, the present invention can provide a surface treatment method for aluminum or an aluminum alloy which can prevent the film thinning phenomenon occurring in the surface treatment of aluminum immediately after bath preparation and thereby make the thickness of the formed film uniform among aluminum products, as well as a treating fluid used therefor. Moreover, since the surface treatment method of the present invention requires no equipment for electric supply, it can simplify the equipment and is hence highly advantageous from the viewpoint of cost. Moreover, it has a high rate of film formation on the surface of aluminum and can hence achieve high productivity. Furthermore, the resulting surface-coated aluminum and the like have excellent sliding properties, corrosion resistance and like properties.

BRIEF DESCRIPTION OF THE DRAWINGS

Embodiments of the present invention will be described hereinbelow with reference to the accompanying drawings in which.

DETAILED DESCRIPTION OF THE PREFERRED EMBODIMENTS

Figure 1:
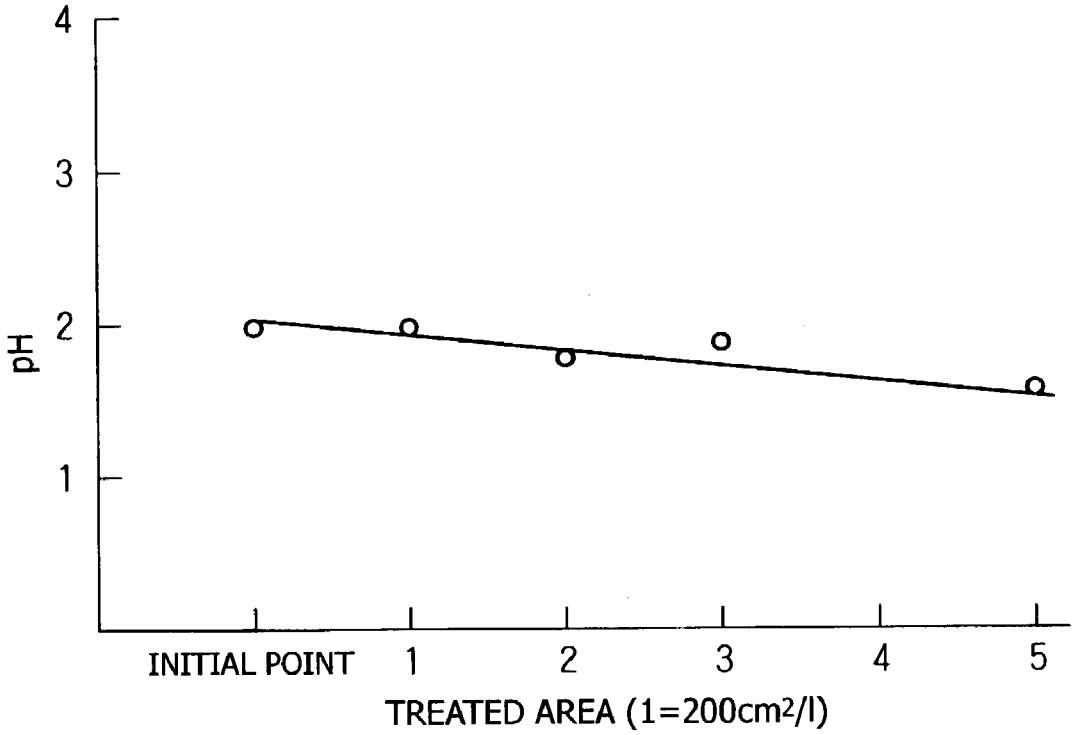
FIG. 1 is a graph showing the relationship between the pH of the treating fluid and the treated area of aluminum in one embodiment of the surface treatment method of the present invention.

The treating fluid used in the present invention contains ammonium silicofluoride [$(NH_4)_2SiF_6$] and another aluminum-free fluorine compound. The other aluminum-free fluorine compound may be any fluorine-containing compound, except ammonium silicofluoride and aluminum compounds. Specific examples thereof include silicofluorides such as magnesium silicofluoride ($MgSiF_6.6H_2O$), zinc silicofluoride ($ZnSiF_6.6H_2O$), potassium silicofluoride ($K_2SiF_6$), sodium silicofluoride ($Na_2SiF_6$) and manganese silicofluoride ($MnSiF_6.6H_2O$); borofluorides; zirconium fluorides; and titanium fluorides. Among these fluorine compounds, silicofluorides are preferably used and, in particular, magnesium silicofluoride and the like are preferably used. The use of this treating fluid makes it possible to form a film having excellent sliding properties, corrosion resistance and like properties on the surface of aluminum.

As to the compounding proportions of ammonium silicofluoride and the aforesaid other aluminum-free fluorine compound, ammonium silicofluoride is preferably used in an amount of 0.05 to 15 parts by weight, more preferably 0.1 to 10 parts by weight, per 100 parts by weight of water; and the fluorine compound is preferably used in an amount of 0.1 to 20 parts by weight, more preferably 0.2 to 15 parts by weight, per 100 parts by weight of water. If the amount of ammonium silicofluoride is less than 0.05 part by weight, or if the amount of the fluorine compound is less than 0.1 part by weight, the reaction will undesirably be retarded to prolong the treating time. On the other hand, if the amount of ammonium silicofluoride is greater than 15 parts by weight, or if the amount of the fluorine compound is greater than 20 parts by weight, it will be undesirable because of difficulty in dissolving them.

Moreover, in addition to the aforesaid ammonium silicofluoride and the like, the treating fluid used in the present invention contains an aluminum-containing substance or powdered aluminum having the same effect as aluminum dissolution occurring immediately after bath preparation. Specific examples of the aluminum-containing substance include aluminum fluoride ($AlF_3$), aluminum hydroxide [$Al(OH)_3$], aluminum silicate [$Al_2(SiO_3)_3$] and magnesium aluminate metasilicate [$Mg(OAlSiO_3)_2$]. Among these aluminum-containing substances, aluminum fluoride or the like is preferably used. It is undesirable to use a compound releasing an ion other than those possessed by the above-illustrated substances, because the properties of the formed film may be different from the expected ones. Although these aluminum-containing substances and powdered aluminum do not dissolve at a pH of the order of 2, they can readily dissolve in the treating fluid of the present invention because of the addition of the aforesaid fluorine compounds.

As to the compounding proportions of the aluminum-containing substances and powdered aluminum, aluminum fluoride is preferably used in an amount of 0.02 to 0.5 part by weight, more preferably 0.04 to 0.2 part by weight, per 100 parts by weight of water; aluminum hydroxide is preferably used in an amount of 0.02 to 0.5 part by weight, more preferably 0.04 to 0.2 part by weight, per 100 parts by weight of water; aluminum silicate is preferably used in an amount of 0.04 to 1 part by weight, more preferably 0.06 to 0.4 part by weight, per 100 parts by weight of water; magnesium aluminate metasilicate is preferably used in an amount of 0.04 to 1 part by weight, more preferably 0.06 to 0.4 part by weight, per 100 parts by weight of water; and powdered aluminum is preferably used in an amount of 0.007 to 0.2 part by weight, more preferably 0.009 to 0.05 part by weight, per 100 parts by weight of water.

When not less than 0.02 part by weight of aluminum fluoride or aluminum hydroxide, not less than 0.04 part by weight of aluminum silicate or magnesium aluminate metasilicate, or not less than 0.007 part by weight of powdered aluminum is added, the pH of the treating fluid immediately after bath preparation can be adjusted to about 2.5 or less, so that the thinning phenomenon of the film formed on the surface of aluminum immediately after the start of the treatment can be prevented. On the other hand, if the amount of aluminum fluoride or aluminum hydroxide is greater than 0.5 part by weight, the amount of aluminum silicate or magnesium aluminate metasilicate is greater than 1 part by weight, or the amount of powdered aluminum is greater than 0.2 part by weight, it will be undesirable because of difficulty in dissolving them.

Furthermore, in addition to the aforesaid aluminum-containing substances and the like, the treating fluid used in the present invention may optionally contain a chemical agent which exerts a buffering action on the hydrogen ion concentration. Specific examples of the chemical agent used in the treating fluid of the present invention include potassium chloride (KCl), potassium hydrogen phthalate [$C_6H_4(COOK)(COOH)$] and potassium dihydrogen phosphate ($KH_2PO_4$). Among these potassium compounds, potassium chloride is preferably used. The addition of such a potassium compound makes it possible to minimize changes in the pH of the treating fluid which will cause variation in film thickness.

As to the compounding proportions of the potassium compounds, potassium chloride is preferably used in an amount of 0.01 to 5 parts by weight, more preferably 0.02 to 1 part by weight, per 100 parts by weight of water; potassium hydrogen phthalate is preferably used in an amount of 0.05 to 10 parts by weight, more preferably 0.08 to 5 parts by weight, per 100 parts by weight of water; and potassium dihydrogen phosphate is preferably used in an amount of 0.03 to 10 parts by weight, more preferably 0.05 to 5 parts by weight, per 100 parts by weight of water. When the compounding proportions of the aforesaid potassium compounds are within these ranges, changes in pH can be reduced to about 1 or less, so that variation in the thickness of the film formed on the surface of aluminum can be suppressed to an even lower level.

The material subjected to the surface treatment of the present invention is aluminum or an aluminum alloy. Specific examples thereof include pure aluminum, flattened aluminum material, cast aluminum and die-cast aluminum material, and the present invention may be applied to any type of material. The surface treatment is effective in improving wear resistance, corrosion resistance and like properties. As a pretreatment for the material to be treated, it is sufficient to remove contaminants (e.g., oil) adhering thereto. However, the surface treatment may be carried out after the material is subjected to an alkali etching with sodium hydroxide or the like, or/and to acid cleaning.

In order to carry out the surface treatment of the present invention, the aluminum or aluminum alloy to be treated is soaked in the aforesaid treating fluid (i.e., the heated aqueous solution). The temperature of the treating fluid in which the aluminum or aluminum alloy is soaked is usually in the range of 70 to 100° C., preferably 75 to 99° C., and more preferably 80 to 98° C. If the temperature of the treating fluid is lower than 70° C., the reaction will undesirably be retarded to prolong the treating time. On the other hand, if the temperature of the treating fluid is higher than 100° C., the evaporation of the treating fluid will increase to an undesirable degree. As to the treating time, it is sufficient to soak the material for about 2 minutes because the film-forming reaction is completed in about 1 minute or so. However, since the resulting film has a protective effect, no problem will arise even if the material having the film once formed is soaked for more than 30 minutes.

According to this surface treatment method, the pH of the treating fluid immediately after bath preparation can be reduced to 2.5 or less by previously adding to the treating fluid Al ions which will dissolve thereinto and accumulate therein upon soaking aluminum. Thus, a great shift of pH to the acid side as a result of the dissolution of aluminum immediately after bath preparation can be suppressed, so that the thinning phenomenon of the film formed on the surface of aluminum can be prevented and the film thickness can hence be made uniform among aluminum products.

EXAMPLES

The present invention is more fully explained with reference to the following examples and comparative example. However, these examples are not to be construed to limit the scope of the invention.

Example 1

Figure 2:
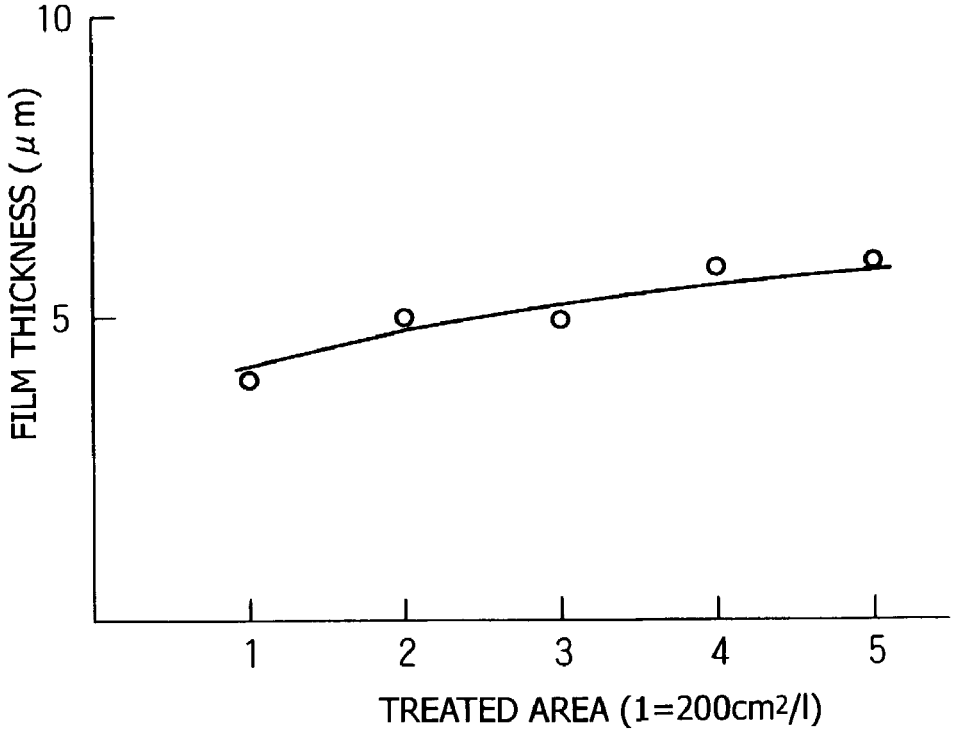
FIG. 2 is a graph showing the relationship between the thickness of the film and the treated area of aluminum in one embodiment of the surface treatment method of the present invention.

First of all, 0.5 part by weight of ammonium silicofluoride and 1 part by weight of magnesium silicofluoride were added to 100 parts by weight of water. Moreover, 0.05 part by weight of aluminum fluoride and 0.1 part by weight of potassium chloride were added thereto and dissolved therein. This solution was heated to 85° C. and used as a treating fluid. An AC8A-T6 cast aluminum specimen having a surface area of 200 $cm^2$ was cleaned with an organic solvent and a degreasing agent, and then subjected to a surface treatment by soaking it in 1 L of the treating fluid for 5 minutes. It was confirmed by X-ray diffractometry that a film consisting of $NH_4MgAlF_6$ was formed on the treated surface of the cast aluminum specimen. Similarly, four cast aluminum specimens were subjected to a surface treatment by soaking them successively in the treating fluid. Moreover, the pH of the treating fluid was measured at the time of soaking each specimen, and the thickness of the formed film (i.e., the film thickness) was measured by observing a section of the film under a microscope. The relationships between the pH of the treating fluid and the surface area of the treated cast aluminum specimens (i.e., the treated area) and between the thickness of the film and the treated area are shown in FIGS. 1 and 2, respectively.

Comparative Example 1

The surface treatment of cast aluminum specimens was carried out under the same conditions as in Example 1, except that aluminum fluoride and potassium chloride were not added to the treating fluid. Similarly to Example 1, a film consisting of $NH_4MgAlF_6$ was formed on the treated surface of the cast aluminum specimens. The relationships between the pH of the treating fluid and the surface area of the treated cast aluminum specimens (i.e., the treated area) and between the thickness of the film and the treated area are shown in FIGS. 3 and 4, respectively.

Figure 3:
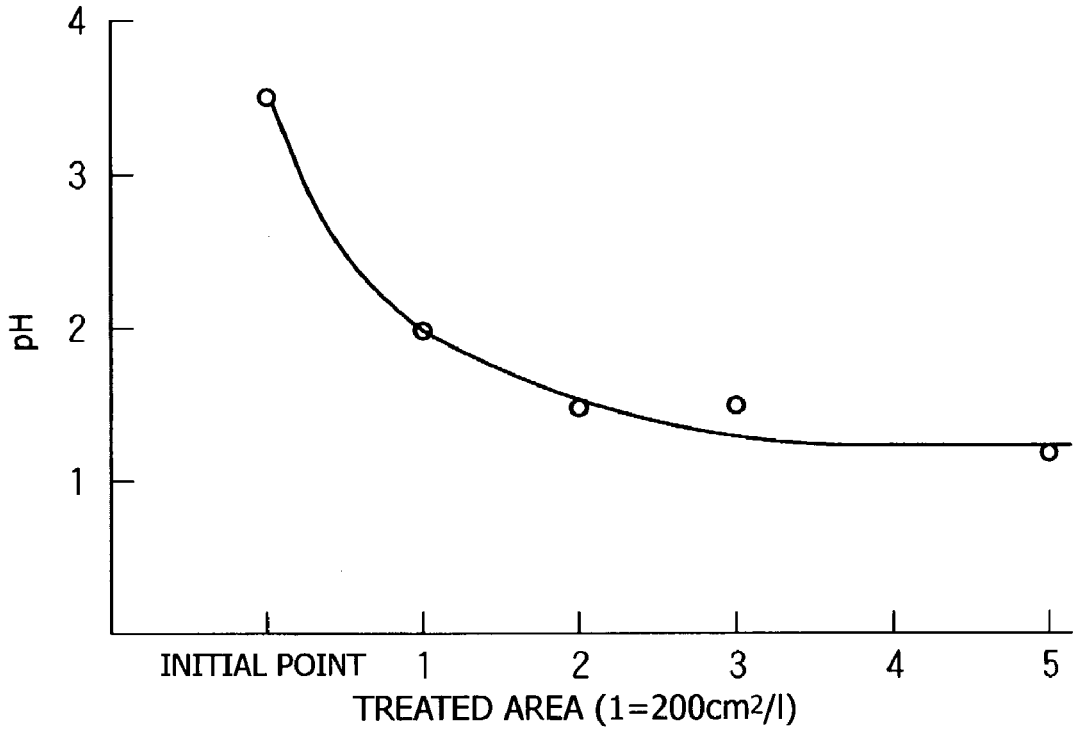
FIG.3 (RELATED ART)
FIG. 3 is a graph showing the relationship between the pH of the treating fluid and the treated area of aluminum in a conventional surface treatment method.
Figure 4:
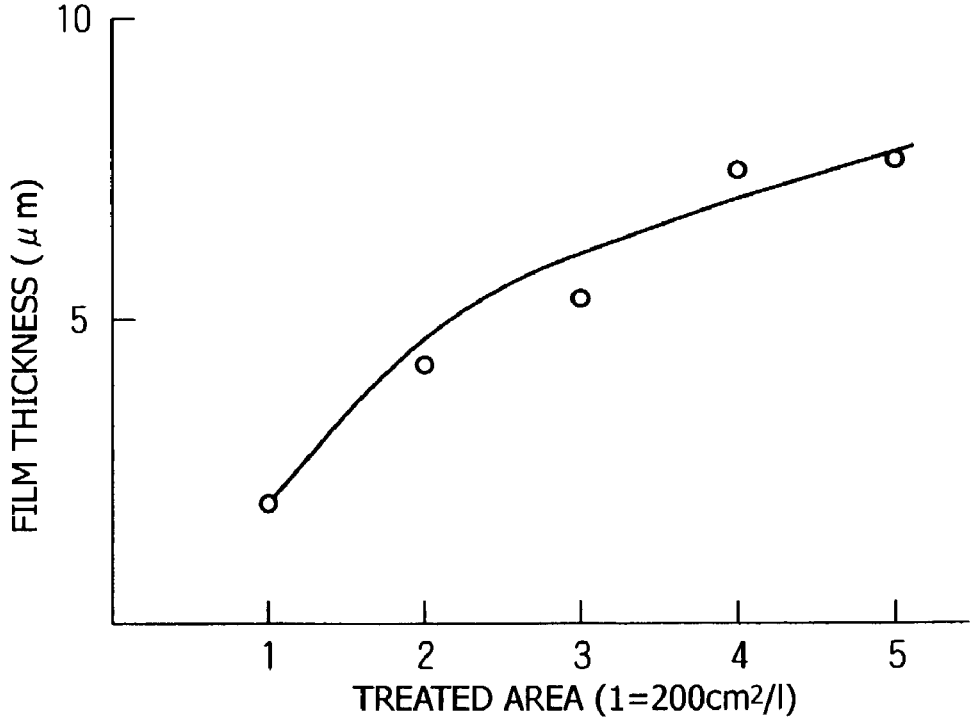
FIG.4 (RELATED ART)
FIG. 4 is a graph showing the relationship between the thickness of the film and the treated area of aluminum in a conventional surface treatment method.

As shown in FIGS. 3 and 4, Comparative Example 1 indicates that the pH of the treating fluid immediately after bath preparation was as high as about 3.5 and the thickness of the formed film was as small as about 2 μm. As the treated area increased, the pH of the treating fluid was greatly reduced from about 3.5 to about 1.0 and the film thickness was greatly increased from about 2 μm to about 8 μm. That is, there was great variation in film thickness among specimens. On the other hand, as shown in FIGS. 1 and 2, Example 1 indicates that the pH of the treating fluid was remained constant in the range of 1.5 to 2.0 and the film thickness was uniform in the range of 4 to 6 μm. From these results, it could be confirmed that changes in pH due to aluminum dissolution were the cause of variation in film thickness.

Example 2

Figure 5:
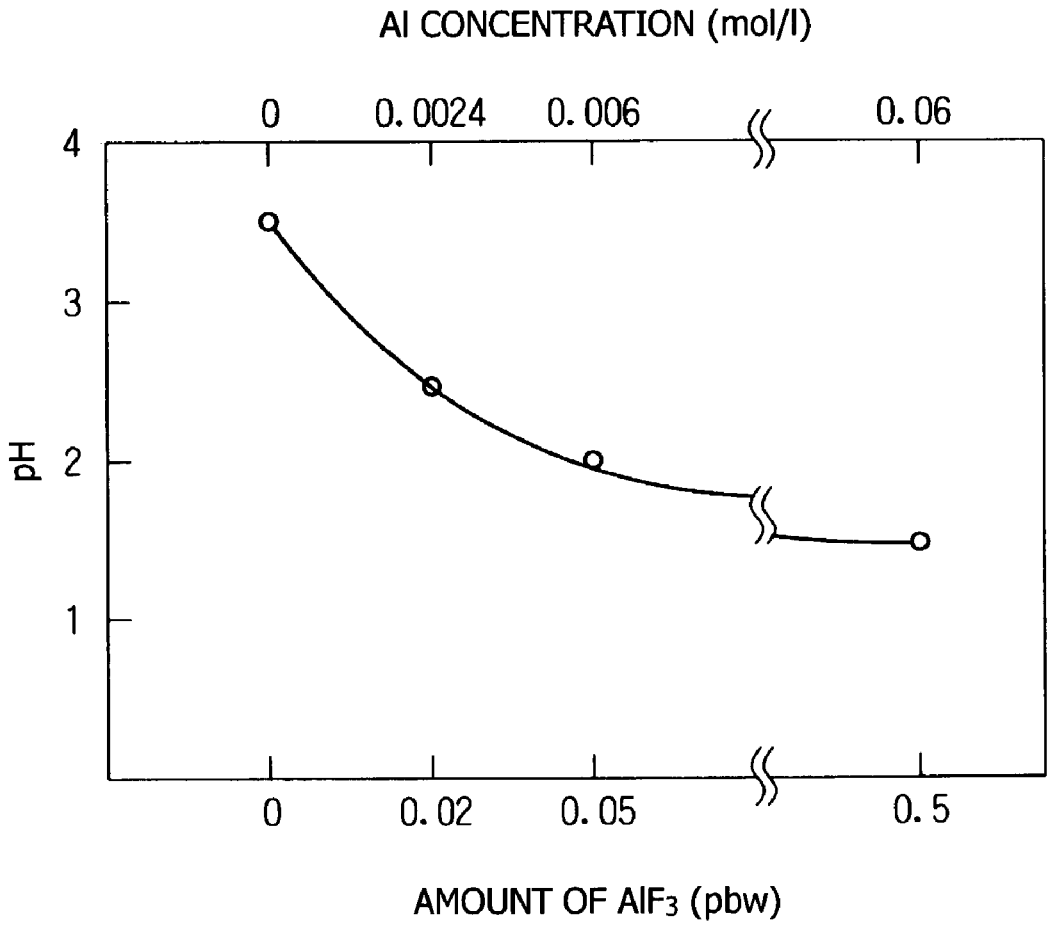
FIG. 5 is a graph showing the relationship between the pH of the treating fluid and the amount of aluminum fluoride or the aluminum concentration in one embodiment of the surface treatment method of the present invention.

In the preparation of the treating fluid of Example 1, the amount of aluminum fluoride added was varied from 0 to 0.5 part by weight, and the pH of the resulting treating fluid was measured. The relationship between the pH of the treating fluid and the amount of aluminum fluoride added (in parts by weight) or the aluminum concentration in the treating fluid (in mol/l) is shown in FIG. 5. As shown in FIG. 5, it can be seen that, in order to reduce the pH of the treating fluid immediately after bath preparation to 2.5 or less, aluminum fluoride should be added in an amount of not less than 0.02 part by weight (corresponding to an aluminum concentration of not less than 0.0024 mol/l).

Example 3

Figure 6:
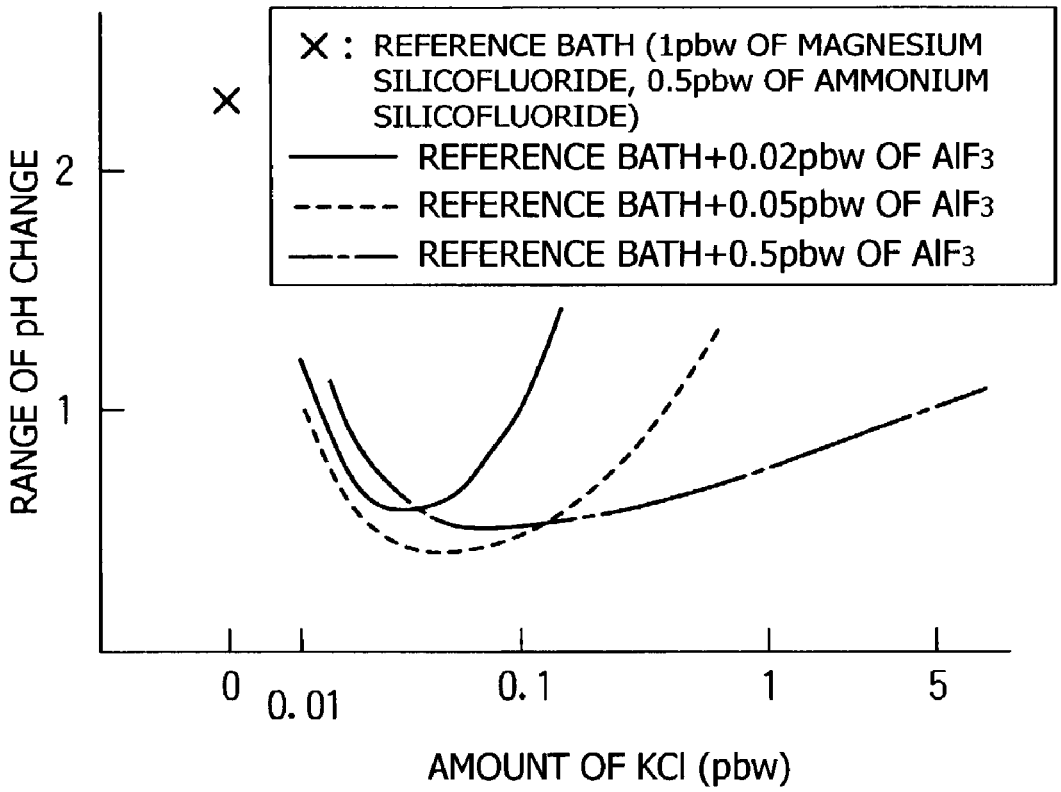
FIG. 6 is a graph showing the relationship between the range of pH change and the amount of potassium chloride in one embodiment of the surface treatment method of the present invention.
Figure 7:
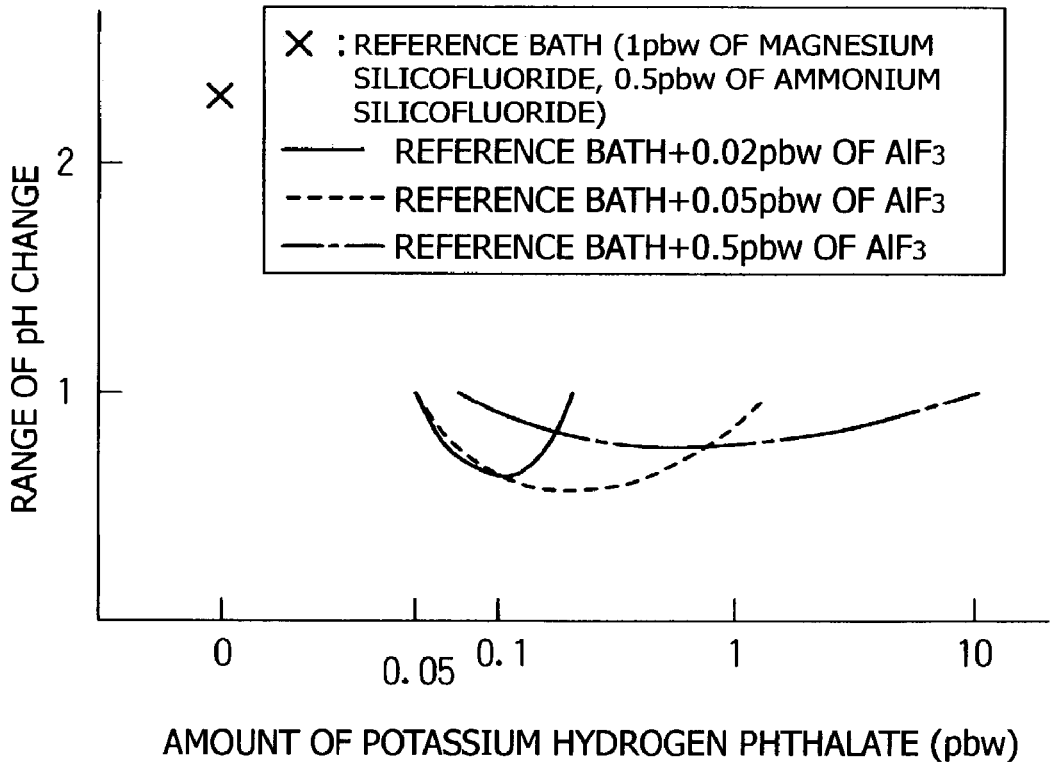
FIG. 7 is a graph showing the relationship between the range of pH change and the amount of potassium hydrogen phthalate in one embodiment of the surface treatment method of the present invention.
Figure 8:
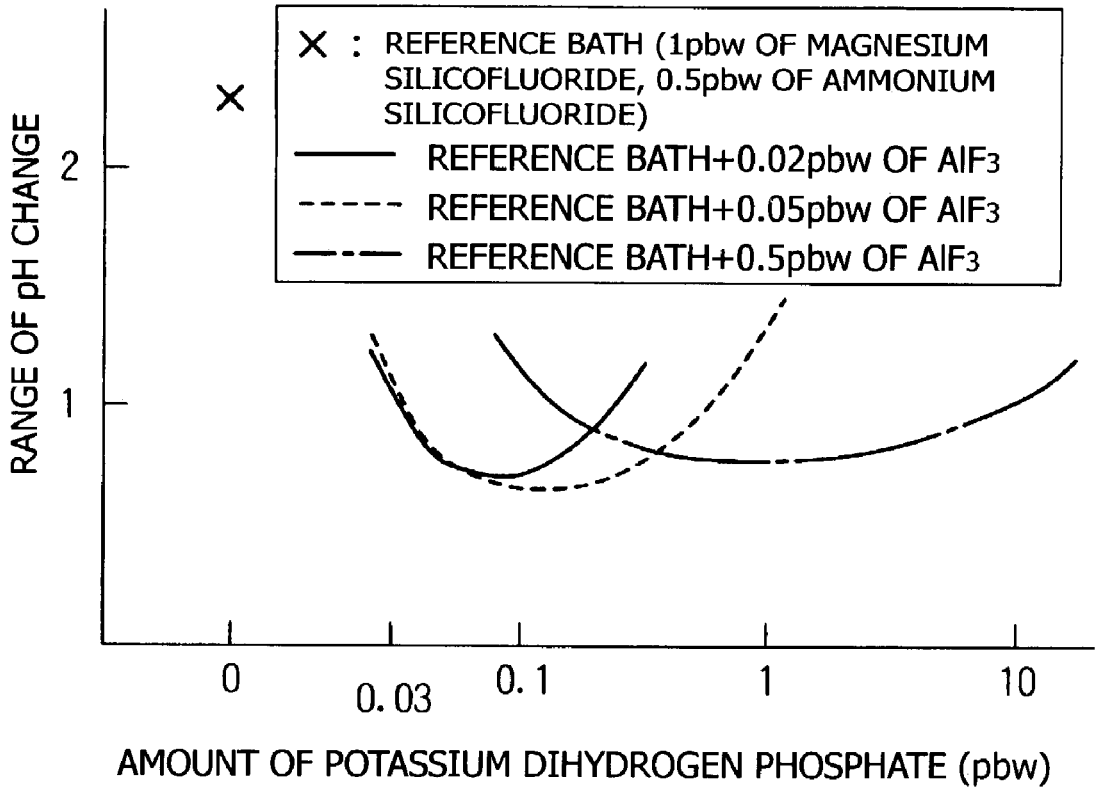
FIG. 8 is a graph showing the relationship between the range of pH change and the amount of potassium dihydrogen phosphate in one embodiment of the surface treatment method of the present invention.

A reference bath was prepared by adding 1 part by weight of magnesium silicofluoride and 0.5 part by weight of ammonium silicofluoride to 100 parts by weight of water, and aluminum fluoride was added thereto in an amount of 0.02, 0.05 or 0.5 part by weight. Using the resulting three treating fluids, the surface treatment of cast aluminum specimens was carried out under the same conditions as in Example 1, except that, for each treating fluid, the amount of potassium chloride added was varied from 0.01 to 5 parts by weight. Then, the difference between the pH of the treating fluid before soaking the first specimen and the pH of the treating fluid after soaking the fifth specimen (i.e., the range of pH change) was determined. The relationship between the range of pH change and the amount of potassium chloride added is shown in FIG. 6. Moreover, the results obtained by adding 0.05 to 10 parts by weight of potassium hydrogen phthalate in place of potassium chloride are shown in FIG. 7, and the results obtained by adding 0.03 to 10 parts by weight of potassium dihydrogen phosphate are shown in FIG. 8.

As shown in FIG. 6, the range of pH change was greater than 2 for the reference bath. However, the range of pH change could be reduced to 1 or less by adding a specified amount of potassium chloride. Moreover, the range of pH change could also be reduced to 1 or less by adding a specified amount of potassium hydrogen phthalate or potassium dihydrogen phosphate.

Many other variations and modifications of the invention will be apparent to those skilled in the art without departing from the spirit and scope of the invention. The above-described embodiments are, therefore, intended to be merely exemplary, and all such variations and modifications are intended to be included within the scope of the invention as defined in the appended claims.

The disclosure of Japanese Patent Application No. 2002-116891 filed on Apr. 19, 2002 including specification, claims, drawings and summary are incorporated herein by reference in its entirety.

What is claimed is:

1. A method for the surface treatment of aluminum or an aluminum alloy, comprising the steps of:

preparing a treating fluid having a pH of 2.5 or less, consisting of ammonium silicofluoride, an aluminum-free fluorine compound other than aluminum silicofluoride, a first substance, a second substance and water, by adding: ammonium silicofluoride in an amount of 0.01 to 10 parts by weight, the aluminum-free fluorine compound other than aluminum silicofluoride in an amount of 0.1 to 20 parts by weight, the first substance in a given amount selected from the group consisting of aluminum hydroxide in an amount of 0.02 to 0.5 part by weight, aluminum silicate in an amount of 0.04 to 1 part by weight, magnesium aluminate metasilicate in an amount of 0.04 to 1 part by weight, and powdered aluminum in an amount of 0.007 to 0.2 part by weight, per 100 parts by weight of water, and the second substance in a given amount selected from the group consisting of potassium chloride in an amount of 0.01 to 5 parts by weight, potassium hydrogen phthalate in an amount of 0.05 to 10 parts by weight, and potassium dihydrogen phosphate in an amount of 0.03 to 10 parts by weight, per 100 parts by weight of water into water; and soaking aluminum or an aluminum alloy in said treating fluid to form a film thereon.

2. The method for the surface treatment of aluminum or an aluminum alloy of claim 1, wherein said aluminum-free fluorine compound other than aluminum silicofluoride is selected from the group consisting of magnesium silicofluoride, zinc silicofluoride, potassium silicofluoride, sodium silicofluoride and manganese silicofluoride.

3. The method for the surface treatment of aluminum or an aluminum alloy of claim 1, wherein the temperature of the treating fluid in the step of soaking aluminum or aluminum alloy is in the range of 70 to 100° C.

* * * * *

UNITED STATES PATENT AND TRADEMARK OFFICE

CERTIFICATE OF CORRECTION

PATENT NO. : 8,075,709 B2
APPLICATION NO. : 10/386230
DATED : December 13, 2011
INVENTOR(S) : Mihoya It is certified that error appears in the above-identified patent and that said Letters Patent is hereby corrected as shown below:

On the Title Page:
Item (75) Inventor: Please correct "Hamamatsu (JP)"
to read -- Hamamatsu-shi (JP) --

IN the Specifications:
Column 1, Line 5: Please insert the following paragraph immediately following the patent title -- Related Application
This application claims priority from Japanese Patent Application No. 2002-116891 filed April 19, 2002, the disclosure of which is incorporated by reference herein in its entirety. --

Signed and Sealed this
Tenth Day of April, 2012

David J. Kappos

David J. Kappos
*Director of the United States Patent and Trademark Office*